US007773052B2

(12) United States Patent
Kamada et al.

(10) Patent No.: US 7,773,052 B2
(45) Date of Patent: Aug. 10, 2010

(54) DISPLAY DEVICE AND METHOD OF DRIVING THE SAME USING PLURAL VOLTAGES

(75) Inventors: Masaki Kamada, Fujisawa (JP); Takashi Shiizaki, Yokohama (JP)

(73) Assignee: Fujitsu Hitachi Plasma Display Limited, Miyazaki (JP)

( * ) Notice: Subject to any disclaimer, the term of this patent is extended or adjusted under 35 U.S.C. 154(b) by 1009 days.

(21) Appl. No.: 11/514,971

(22) Filed: Sep. 5, 2006

(65) Prior Publication Data

US 2007/0057870 A1 Mar. 15, 2007

(30) Foreign Application Priority Data

Sep. 9, 2005 (JP) ..... 2005-262806

(51) Int. Cl.
*G09G 3/28* (2006.01)

(52) U.S. Cl. ..... 345/66; 345/60; 345/63; 345/204; 315/169.4

(58) Field of Classification Search ..... 345/66, 345/60, 63, 204; 315/169.4
See application file for complete search history.

(56) References Cited

U.S. PATENT DOCUMENTS 6,844,685 B2 1/2005 Lee
2002/0003514 A1* 1/2002 Liu et al. ..... 345/60
2004/0085262 A1* 5/2004 Lee ..... 345/41
2004/0257304 A1* 12/2004 Yamamoto et al. ..... 345/60

FOREIGN PATENT DOCUMENTS

CN 1495690 5/2004
WO 97/20301 6/1997

OTHER PUBLICATIONS

Office Action mailed on Mar. 10, 2008 and issued in corresponding Chinese Patent Application No. 2006101514544.
Office Action mailed on May 10, 2008 and issued in corresponding Chinese Patent Application No. 2006101514544.

* cited by examiner

*Primary Examiner*—Lun-Yi Lao
*Assistant Examiner*—Priyank Shah
(74) *Attorney, Agent, or Firm*—Staas & Halsey LLP

(57) ABSTRACT

There is provided a plasma display device including a slope waveform generating circuit which supplies to an electrode a slope waveform of which voltage changes with the lapse of time, the electrode being formed in a capacitive load to serves as a display element in a display panel for displaying images, wherein the slope waveform generating circuit includes: a plurality of power supplies which supply different voltages; and a switching circuit which selects one power supply out of the a plurality of power supplies and supplies a voltage to the electrode, wherein the switching circuit switches the power supply, which supplies a voltage to the electrode, in accordance with a voltage being supplied to the electrode.

19 Claims, 7 Drawing Sheets

DISPLAY DEVICE AND METHOD OF DRIVING THE SAME USING PLURAL VOLTAGES

CROSS-REFERENCE TO RELATED APPLICATIONS

This application is based upon and claims the benefit of priority from the prior Japanese Patent Application No. 2005-262806, filed on Sep. 9, 2005, the entire contents of which are incorporated herein by reference.

BACKGROUND OF THE INVENTION

1. Field of the Invention

The present invention relates to plasma display devices and methods of driving the same.

2. Description of the Related Art

In a plasma display device, initialization of display cells is carried out prior to selecting the lighting or non-lighting of each display cell by addressing. In the initialization of display cells, a write operation and an erase operation with respect to the display cells are carried out. In order to suppress deterioration in contrast due to background luminescence, the writing and erasing are carried out by a weak electric discharge. The weak electric discharge in each display cell is generally realized using a slope waveform (graded waveform) of which voltage changes with the lapse of time (for example, see Patent-document 1).

In the conventional plasma display device, the slope waveform is usually generated by supplying an electric power to an electrode of a display cell through a constant current circuit from the power supply capable of outputting an ultimate voltage in the slope waveform. For this reason, a difference between the supply voltage and the electrode voltage is applied to a driving circuit.

As the display panel in a plasma display device becomes large, the load associated with the driving will increase. However, with regards to the time required for reaching the ultimate voltage in the slope waveform, approximately the same time period is required in specification irrespective of the size of the display panel. Accordingly, as the display panel is enlarged, the electric current required for applying the slope waveform will increase, which gives rise to problems, such as a rise in the component temperature due to the increase in the reactive power (loss). Moreover, also in the case where the uniformity of the display cells in the display panel is damaged as the display panel becomes larger, the number of times of applying the slope waveform for initializing the display cells will increase, which causes problems, such as a rise in the component temperature due to an increase in the reactive power (loss).

[Patent document 1] International Publication No. 97/20301

SUMMARY OF THE INVENTION

It is an object of the present invention to provide plasma display devices capable of reducing the loss in the driving circuit associated with applying the slope waveform, and methods of driving the same.

According to an aspect of the present invention, a plasma display device comprises: a plasma display panel which displays images by applying a sustain discharge voltage to a capacitive load, the capacitive load being to serve as a display element; and a slope waveform generating circuit which supplies to an electrode formed at the capacitive load a slope waveform of which voltage changes with the lapse of time, wherein the slope waveform generating circuit comprises a plurality of power supplies for supplying different voltages, and a switching circuit for selecting the power supply out of the plurality of power supplies and supplying a voltage to the electrode, wherein in accordance with a voltage being supplied to the electrode, the switching circuit switches the power supply which supplies a voltage to the electrode.

According to an aspect of the present invention, there is provided a method of driving a plasma display device, the plasma display device including a plasma display panel which displays images by applying a sustain discharge voltage to a capacitive load, the capacitive load being to serve as a display element, wherein when supplying to an electrode formed in the capacitive load a slope waveform in which voltage changes with the lapse of time, among a plurality of power supplies for supplying different voltages, the power supply is sequentially switched in accordance with a voltage being supplied to the electrode to thereby select the power supply and supply a voltage to the electrode.

DETAILED DESCRIPTION OF THE PREFERRED EMBODIMENTS

Hereinafter, embodiments of the present invention will be described in accordance with the accompanying drawings.

Figure 1:
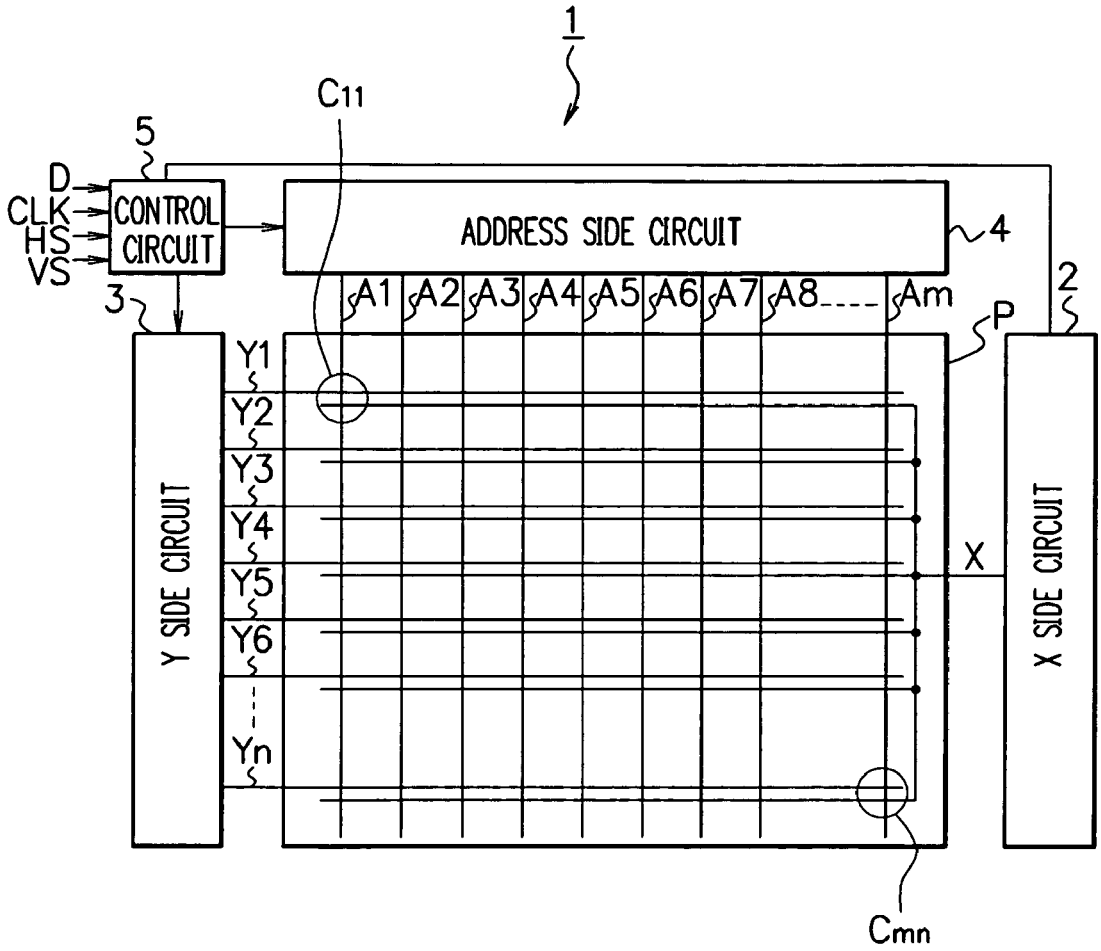
FIG. 1 is a view showing an example of a configuration of a plasma display device according to an embodiment of the present invention.

FIG. 1 is a view showing an example of the configuration of a plasma display device according to an embodiment of the present invention. In a plasma display device 1 in this embodiment, mutually parallel scan electrodes Y1 to Yn and common electrodes X are provided on a first substrate, and on a second substrate facing to the first substrate address electrodes A1 to Am are provided in the direction perpendicular to (so as to intersect with) these electrodes Y1 to Yn and X. The common electrodes X are provided corresponding to and near the respective scan electrodes Y1 to Yn, and one ends thereof are connected together in common.

A display panel P comprises a plurality of cells arranged in a matrix of n rows by m columns. Each cell Cij is formed from the intersection between an address electrode Ai and a scan electrode Yj, and the common electrode X adjacent thereto correspondingly. The cell Cij corresponds to one pixel of a display image, and the display panel P is capable of displaying two-dimensional images.

The common end of the common electrodes X is connected to the output end of an X side circuit 2 which supplies a predetermined voltage (driving pulse) to the common electrodes X. The respective scan electrodes Y1 to Yn are connected to the output end of a Y side circuit 3 which supplies a predetermined voltage (driving pulse) to the scan electrodes Y1 to Yn. The address electrodes A1 to Am are connected to the output end of an address side circuit 4 which supplies a predetermined voltage (driving pulse) to the address electrodes A1 to Am.

The X side circuit 2 consists of a circuit which repeats electric discharge, and the Y side circuit 3 consists of a circuit for line sequential scanning and a circuit which repeats electric discharge. The address side circuit 4 consists of a circuit which selects a column to be displayed. The X side circuit 2, the Y side circuit 3, and the address side circuit 4 are controlled by a control signal supplied from a control circuit 5. The display operation of the plasma display device is carried out by determining which cell to light by means of the circuit for line sequential scanning in the Y side circuit 3 and the address side circuit 4, and by repeating the electric discharge by means of the X side circuit 2 and the circuit for repeating electric discharge in the Y side circuit 3.

Based on display data D from the outside, a clock CLK indicating a read timing of the display data D, a horizontal synchronizing signal HS, and a vertical synchronizing signal VS, the control circuit 5 generates the control signal and supplies the same to the X side circuit 2, the Y side circuit 3, and the address side circuit 4.

Figure 2:
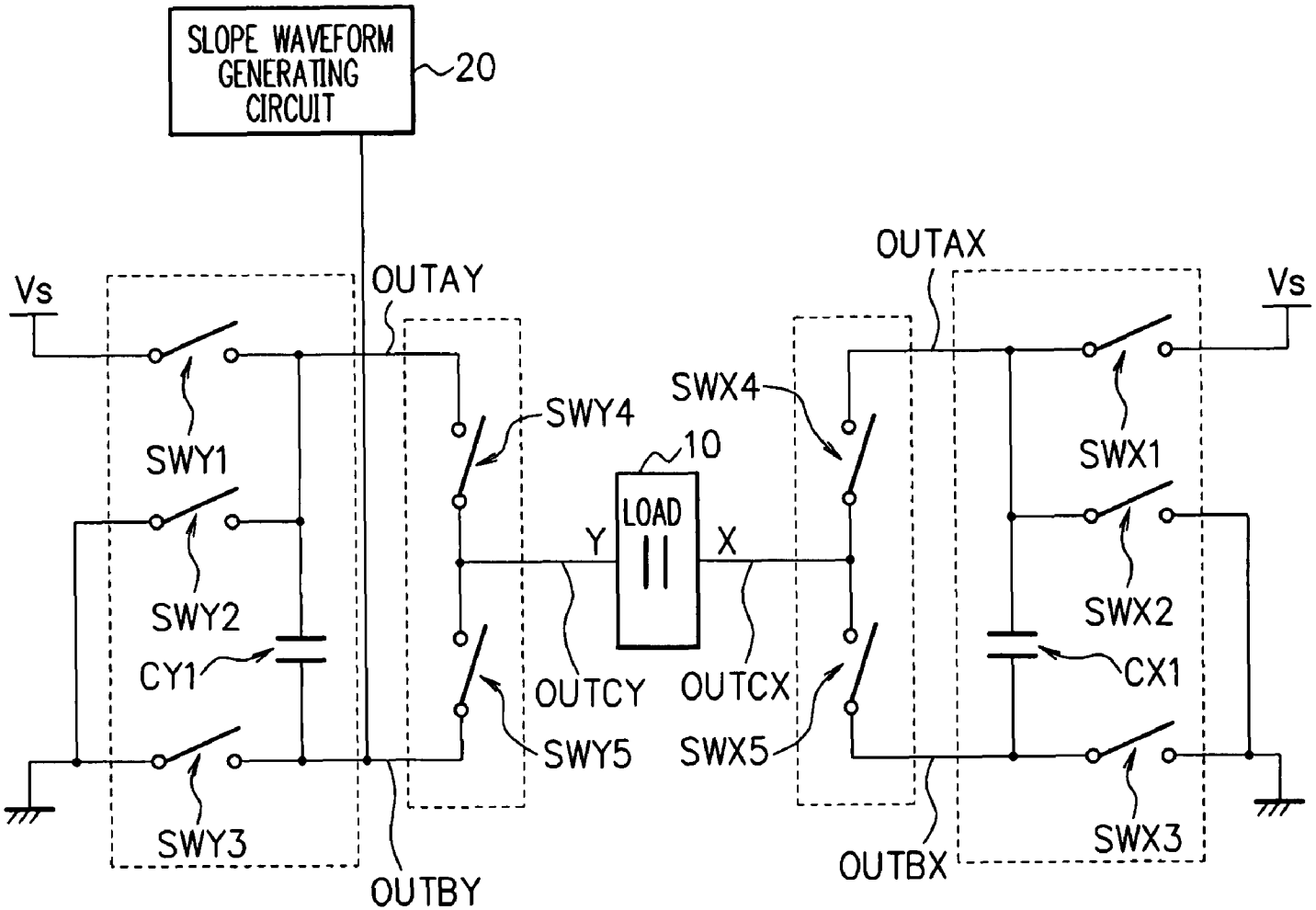
FIG. 2 is a view showing an example of the configuration of a driving circuit of the plasma display device shown in FIG. 1.

FIG. 2 is a view showing an example of the configuration of the driving circuit of the plasma display device shown in FIG. 1. The driving circuit shown in FIG. 2 corresponds to the X side circuit 2 and the Y side circuit 3 in FIG. 1.

In FIG. 2, a capacitive load (hereinafter, referred to as a "load") 10 to serve as a display element is a capacitance of total of cells formed in between one common electrode X and one scan electrode Y. In the load 10, the common electrode X and the scan electrode Y are formed. The scan electrode Y is an arbitrary scan electrode among the plurality of scan electrodes Y1 to Yn.

The Y side circuit for driving the scan electrode Y comprises one capacitor CY1 and five switches SWY1 to SWY5. Moreover, the Y side circuit comprises a slope waveform generating circuit 20.

The switches SWY1 and SWY2 are connected in series between a power supply line of a voltage Vs supplied from a power supply (power supply line), and the ground (GND) as a reference potential. To the interconnection of the two switches SWY1 and SWY2, one terminal of the capacitor CY1 is connected, while between the other terminal of the capacitor CY1 and the ground, the switch SWY3 is connected. In addition, a signal line connected to one terminal of the capacitor CY1 is referred to as a first signal line OUTAY, and a signal line connected to the other terminal is referred to as a second signal line OUTBY.

The switches SWY4 and SWY5 s are connected in series and connected to the both ends of the capacitor CY1. That is, the switches SWY4 and SWY5 are connected in series between the first and second signal lines OUTAY and OUTBY. The interconnection of the two switches SWY4 and SWY5 is connected to the scan electrode Y of the load 10 through an output line OUTCY.

The slope waveform generating circuit 20 is connected to the second signal line OUTBY, and generates and outputs a slope waveform of which signal level (voltage) changes with the lapse of time. In addition, the slope waveform is also referred to as a ramp waveform or a graded waveform. In this embodiment, the rate of change of the signal level in the slope waveform is constant irrespective of the elapsed time.

The X side circuit for driving the common electrode X comprises one capacitor CX1 and five switches SWX1 to SWX5.

The switches SWX1 and SWX2 are connected in series in between a power supply line of the voltage Vs supplied from a power supply and the ground (GND) as the reference potential. To the interconnection of the two switches SWX1 and SWX2, one terminal of the capacitor CX1 is connected, while between the other terminal of the capacitor CX1 and the ground, the switch SWX3 is connected. In addition, the signal line connected to one terminal of the capacitor CX1 is referred to as a third signal line OUTAX, and the signal line connected to the other terminal is referred to as a fourth signal line OUTBX.

The switches SWX4 and SWX5 are connected in series and connected to the both ends of the capacitor CX1. That is, the switches SWX4 and SWX5 are connected in series between the third and fourth signal lines OUTAX and OUTBX. The interconnection of the two switches SWX4 and SWX5 is connected to the common electrode X of the load 10 through an output line OUTCX.

By turning on the switches SWY1, SWY3, and SWY4 at the Y side of the driving circuit shown in FIG. 2 and turning off the switches SWY2 and SWY5, the electric charge corresponding to the voltage Vs provided by the switches SWY1 and SWY3 is stored in the capacitor CY1, and the voltage Vs of the first signal line OUTAY is applied to the load 10 through the output line OUTCY.

Moreover, in the state where the electric charge corresponding to the voltage Vs is stored in the capacitor CY1, by turning on the switches SWY2 and SWY5 and turning off the switches SWY1, SWY3, and SWY4, the voltage of the second signal line OUTBY becomes (−Vs), and the voltage (−Vs) is applied to the load 10 through the output line OUTCY.

In this way, the positive voltage Vs and the negative voltage (−Vs) are applied alternatively to the scan electrode Y of the load 10. Similarly, by carrying out the similar switching control also to the common electrode X of the load 10, the positive voltage Vs and the negative voltage (−Vs) are alternatively applied. At this time, the voltage (±Vs) applied to the scan electrode Y and the common electrode X have their phases opposite to each other. That is, when the positive voltage Vs is applied to the scan electrode Y, the negative voltage (−Vs) is applied to the common electrode X. This may produce a potential difference with which the sustain discharge can be carried out in between the scan electrode Y and the common electrode X.

Figure 3:
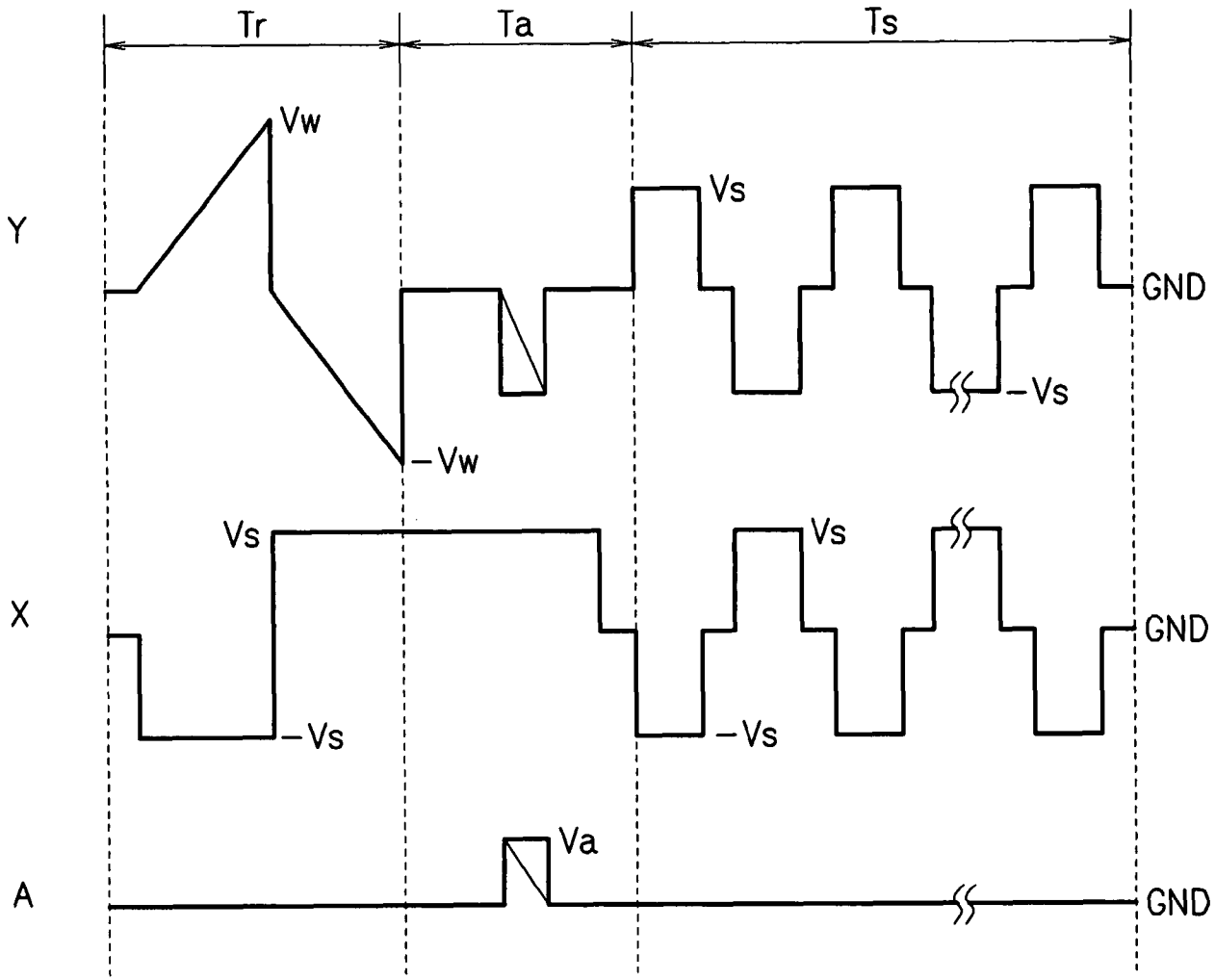
FIG. 3 is a waveform chart showing an example of operation of the plasma display device shown in FIG. 1.

FIG. 3 is a waveform chart showing an example of the basic operation of the plasma display device shown in FIG. 1. FIG. 3 shows an example of the waveform of the driving pulses (voltages) applied to the common electrode X, the scan electrode Y, and the address electrode A in one sub-field out of a plurality of sub-fields constituting one frame. One sub-field is divided into a reset period Tr consisting of a full write period and a full erase period, an address period Ta, and a sustain discharge period Ts. During the reset period Tr, the initialization of the display cells may be carried out, and during the address period Ta, lighting or non-lighting of each display cell can be selected by addressing. The selected cell emits light during the sustain discharge period Ts.

During the reset period, first, the voltage applied to the common electrode X is pulled down to (−Vs) from the ground level as the reference potential. The voltage applied to the scan electrode Y will rise gradually with the lapse of time by the slope waveform generating circuit 20, and finally a write voltage Vw is applied to the scan electrode Y.

In this way, a reset pulse is applied to the common electrode X and the scan electrode Y, and the potential difference between the electrodes becomes (Vs+Vw), and irrespective of the previous display state, an electric discharge is carried out in the whole cells of the whole display lines, thereby forming wall charges (full writing).

Next, after restoring the voltages of the common electrode X and the scan electrode Y to the ground level, the voltage to the common electrode X is pulled up from the ground level to Vs. The voltage applied to the scan electrode Y goes down gradually with the lapse of time by the slope waveform generating circuit 20, and finally is pulled down to the voltage (−Vw). Accordingly, the voltage of the wall charges themselves exceeds a discharge start voltage and discharge starts in all the cells, thereby erasing the stored wall charges (full erasing).

Next, during the address period, in order to turn on/off each cell in accordance with an input video signal (display data), the address discharge is carried out in a line sequential manner. At this time, the voltage Vs is applied to the common electrode X. Moreover, when applying a voltage to the scan electrode Y corresponding to a certain display line, a scan pulse with the level (−Vs) is applied to the scan electrode Y which has been selected in the line sequential manner, and a voltage of the ground level is applied to the scan electrodes not selected.

At this time, to a cell among the respective address electrodes A1 to Am, the cell causing the sustain discharge (i.e., the address electrode Aj corresponding to a cell to light), an address pulse with a voltage of Va is selectively applied. As a result, an electric discharge occurs between the address electrode Aj of the cell to light, and the scan electrode Y selected in a line sequential scanning manner. With this electric discharge being the priming (pilot flame), the wall charges with a quantity capable of causing the next sustain discharge are stored in a MgO protection film surface above the common electrode X and the scan electrode Y.

Thereafter, during the sustain discharge period, the voltages (+Vs, −Vs) of which polarities differ to each other are applied alternatively to the common electrode X and the scan electrode Y of each display line, thereby carrying out the sustain discharge and displaying one sub-field of images. In addition, the operation of alternatively applying voltages of which polarities differ to each other is called the sustain operation, and the pulses of voltages (+Vs, −Vs) during the sustain operation are called the sustain pulses.

Hereinafter, the slope waveform generating circuit 20 in the embodiment of the present invention is described. As described above, the slope waveform generating circuit 20 generates and outputs a slope waveform of which signal level (voltage) changes with the lapse of time at a constant rate of change irrespective of the elapsed time. In the following, as an example, the slope waveform generating circuit 20 is described which generates and outputs the slope waveform of which ultimate voltages are Vw or (−Vw), the slope waveform being applied to the scan electrode Y during the reset period Tr shown in FIG. 3.

First Embodiment

Figure 4A:
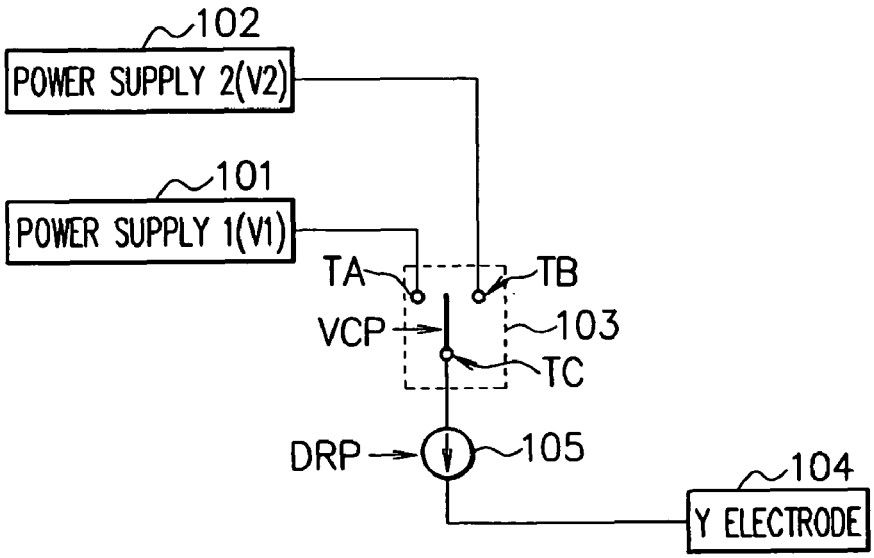
FIG. 4A is a view showing an example of a slope waveform generating circuit in a first embodiment.
Figure 4B:
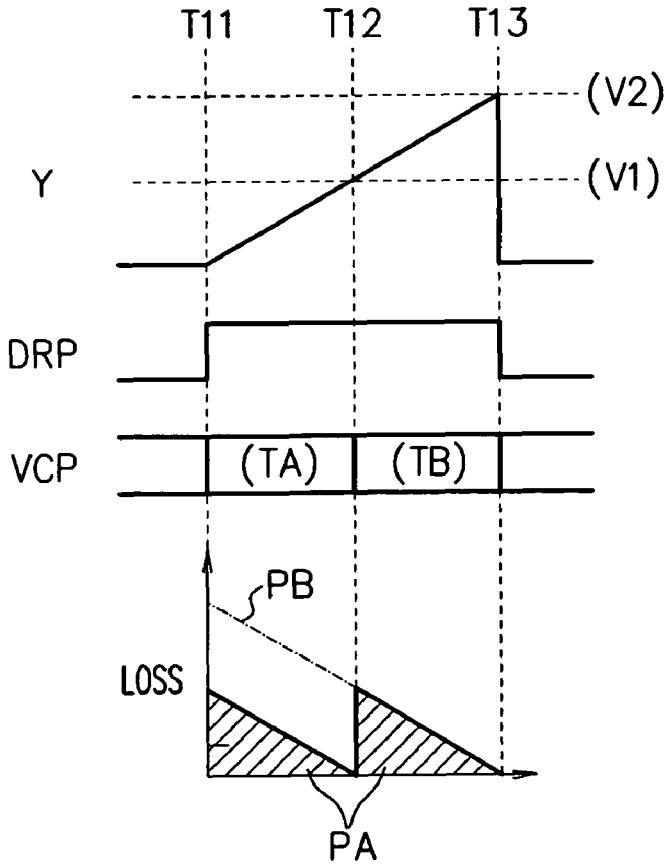
FIG. 4B is a waveform chart showing an example of the operation of the slope waveform generating circuit shown in FIG. 4A.

FIG. 4A and FIG. 4B are views showing an example of the slope waveform generating circuit 20 in a first embodiment of the present invention. The slope waveform generating circuit 20 in the first embodiment generates and outputs a slope waveform of which ultimate voltage is a positive voltage Vw relative to the reference voltage.

FIG. 4A shows an example of a configuration of the slope waveform generating circuit in the first embodiment.

In FIG. 4A, a reference numeral 101 represents a first power supply for supplying a voltage V1, and a reference numeral 102 represents a second power supply for supplying a voltage V2. Here, the voltage V2 is equal to the ultimate voltage Vw of the slope waveform, and the voltage V1 is a voltage of approximately ½ of the voltage V2. In addition the voltage V1 is preferably ½ of the voltage V2 in order to minimize the reactive power (loss) as described later.

A reference numeral 103 represents a switching circuit. A first terminal TA of the switching circuit 103 is connected to the first power supply 101, and a second terminal TB is connected to the second power supply 102. A third terminal TC of the switching circuit 103 is connected to a scan electrode Y 104 through a constant current circuit 105. The switching circuit 103 is controlled by a switching signal VCP to thereby connect the first terminal TA and the third terminal TC, or the second terminal TB and the third terminal TC, selectively.

The constant current circuit 105 is for supplying an electric power to the scan electrode Y 104, and is controlled by a driving signal DRP for generating a slope waveform.

The switching signal VCP and the driving signal DRP are supplied from the control circuit 5 shown in FIG. 1.

FIG. 4B shows an example of operation of the slope waveform generating circuit shown in FIG. 4A. When applying the slope waveform of the ultimate voltage V2 shown in FIG. 4B to the scan electrode Y 104, first, the driving signal DRP is turned on and the constant current circuit 105 is turned on. At this time, in the switching circuit 103, the first terminal TA and the third terminal TC are connected in accordance with the switching signal VCP being supplied. Accordingly, an electric power is supplied to the scan electrode Y 104 from the first power supply 101 through the constant current circuit 105 (at time T11).

Then, when the voltage applied to the scan electrode Y 104 rises with the lapse of time and reaches the voltage V1 (at time T12), the switching signal VCP is switched and in accordance with the switching signal VCP the second terminal TB and the third terminal TC are connected in the switching circuit 103. Accordingly, an electric power is supplied to the scan electrode Y 104 from the second power supply 102 through the constant current circuit 105. Then, after the voltage applied to the scan electrode Y 104 reaches the ultimate voltage V2, the driving signal DRP is turned off and the constant current circuit 105 is turned off (at time T13).

In this way, in this embodiment, with the use of the power supplies 101 and 102 which supply the voltages V1 and V2, respectively, after the voltage V1 is applied by the power supply 101, the voltage V2 is subsequently applied by the power supply 102, thereby applying the slope waveform of the ultimate voltage V2 to the scan electrode Y 104. That is, by supplying the voltage in the ascending order of the potential difference between the voltage to supply and the reference potential (ground level), i.e., from the power supply 101 to the power supply 102, the slope waveform of the ultimate voltage V2 is applied to the scan electrode Y 104. During this period, the difference between the supply voltage and the voltage of the scan electrode Y is applied to the driving circuit, and by switch-controlling the power supplies 101 and 102 which supply an electric power in accordance with the voltage applied to the scan electrode Y 104, a loss PA is reduced as shown in FIG. 4B. For example, in the case where the voltage V1 is a voltage of ½ of the voltage V2, the loss can be reduced to ½ as compared with the conventional one. In addition, in FIG. 4B, the area of the cross-hatched regions corresponds to the loss PA in this embodiment, while the area of the triangle formed by the lines expressing the respective axes and the line PB corresponds to the conventional loss PB.

Figure 5A:
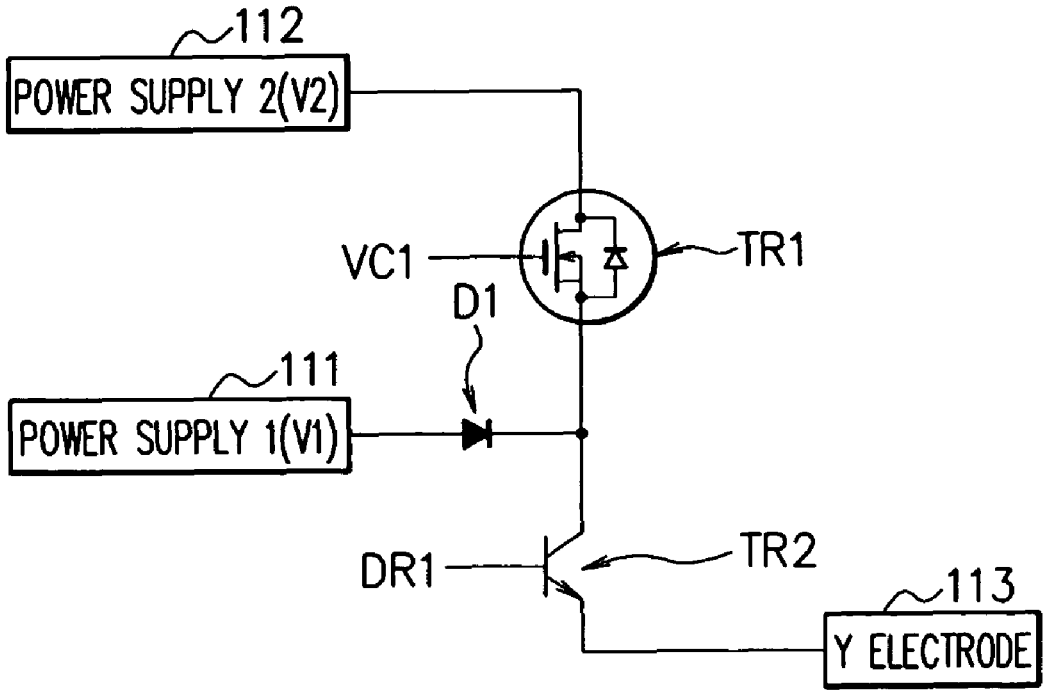
FIG. 5A is a view showing a specific example of the slope waveform generating circuit in the first embodiment.
Figure 5B:
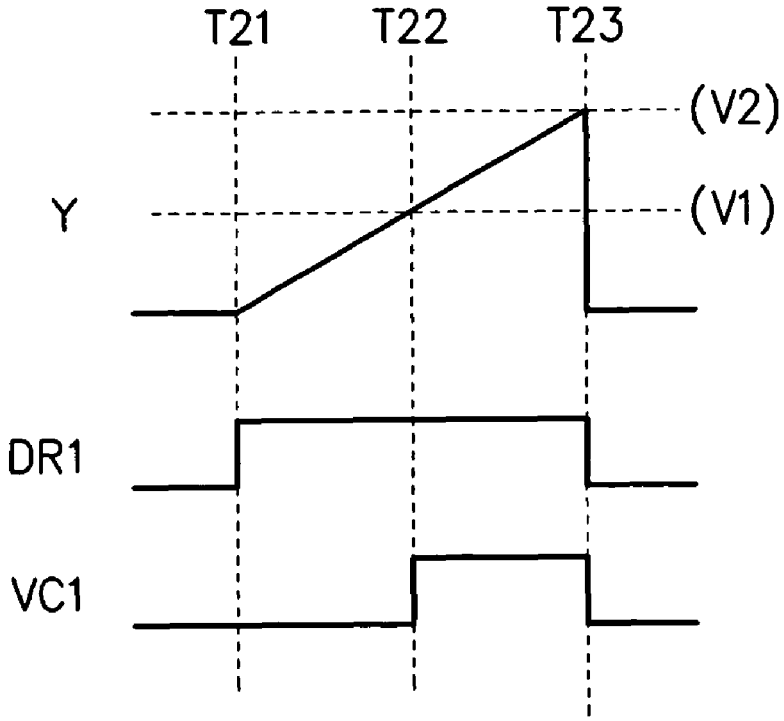
FIG. 5B is a waveform chart showing an example of the operation of the slope waveform generating circuit shown in FIG. 5A.

FIG. 5A and FIG. 5B are views showing a specific example of the slope waveform generating circuit in the first embodiment. FIG. 5A shows an example of a specific configuration example of the slope waveform generating circuit in the first embodiment. A reference numeral 111 represents the first power supply for supplying the voltage V1, and a reference numeral 112 represents the second power supply for supplying the voltage V2. Here, the voltage V2 equals to the ultimate voltage Vw of the slope waveform, and the voltage V1 is a voltage of ½ of the voltage V2.

TR1 represents an MOS transistor as a switching element, and D1 represents a diode. The MOS transistor TR1 and diode D1 correspond to the switching circuit 103 shown in FIG. 4A. TR2 represents a transistor as a constant current circuit and corresponds to the constant current circuit 105 shown in FIG. 4A. The cathode of the diode D1 is connected to the collector of the transistor TR2, and the anode is connected to the power supply 111.

A switching signal VC1 is supplied to the gate of the MOS transistor TR1, which is on/off controlled in accordance with the switching signal VC1. A driving signal DR1 is supplied to the base of the transistor TR2, which is on/off controlled in accordance with the driving signal DR1. The switching signal VC1 and the driving signal DR1 correspond to the switching signal VCP and the driving signal DRP shown in FIG. 4A, respectively.

Next, the example of the operation of the slope waveform generating circuit shown in FIG. 5A is described with reference to FIG. 5B.

When applying the slope waveform of the ultimate voltage V2 to a scan electrode Y 113, first, the driving signal DR1 is turned on while keeping the switching signal VC1 turned off. This turns on the transistor TR2. Accordingly, an electric power is supplied to the scan electrode Y 113 from the first power supply 111 through the diode D1 and the transistor TR2 (at time T21).

Then, when the voltage applied to the scan electrode Y 113 rises with the lapse of time and reaches the voltage V1 (at time T22), the switching signal VC1 is turned on and the MOS transistor TR1 is turned on. At this time, because the potential of the collector of the transistor TR2 is higher than the voltage V1, the diode D1 is cut off. Accordingly, an electric power is supplied from the second power supply 112 through the MOS transistor TR1 and the transistor TR2.

Then, after the voltage applied to the scan electrode Y 113 reaches the ultimate voltage V2, the driving signal DR1 and the switching signal VC1 are turned off (time T23).

In this way, while the MOS transistor TR1 is kept turned off, the transistor TR2 is turned on and an electric power is supplied to the scan electrode Y 113 from the power supply 111. Then, when the voltage applied to the scan electrode Y 113 reaches the V1, the power supply switching is carried out by turning on the MOS transistor TR1, and an electric power is supplied to the scan electrode Y 113 from the power supply 112. In this way, the loss in the driving circuit can be reduced.

Second Embodiment

Next, a second embodiment of the present invention is described.

The slope waveform generating circuit 20 in the second embodiment generates and outputs a slope waveform of which ultimate voltage is a negative voltage (−Vw) relative to the reference voltage.

Figure 6:
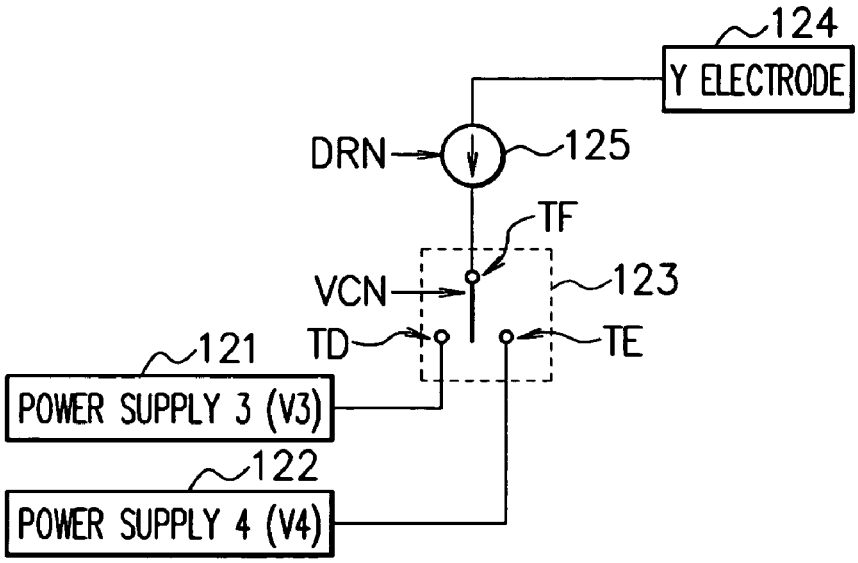
FIG. 6 is a view showing an example of the configuration of a slope waveform generating circuit in a second embodiment.

FIG. 6 is a view showing a configuration example of the slope waveform generating circuit in the second embodiment.

In FIG. 6, a reference numeral 121 represents a third power supply for supplying a voltage V3, and a reference numeral 122 represents a fourth power supply for supplying a voltage V4. Here, the voltage V4 is equal to the ultimate voltage (−Vw) of the slope waveform, and the voltage V3 is a voltage of approximately ½ of the voltage V4. In addition, the voltage V3 is preferably a voltage of ½ of the voltage V4 in order to minimize the reactive power (loss).

A reference numeral 123 represents a switching circuit. A first terminal TD of the switching circuit 123 is connected to the third power supply 121, and a second terminal TE is connected to the fourth power supply 122. A third terminal TF of the switching circuit 123 is connected to a scan electrode Y 124 through a constant current circuit 125. The switching circuit 123 is controlled by a switching signal VCN to thereby connect the first terminal TD and the third terminal TF, or the second terminal TE and the third terminal TF, selectively.

The constant current circuit 125 is for supplying an electric power to the scan electrode Y 124, and is controlled by the driving signal DRN for generating the slope waveform.

The switching signal VCN and the driving signal DRN are supplied from the control circuit 5 shown in FIG. 1.

First, the driving signal DRN is turned on and the constant current circuit 125 is turned on. At this time, in the switching circuit 123, the first terminal TD and the third terminal TF are connected in accordance with the switching signal VCN being supplied. Accordingly, an electric power is supplied to the third power supply 121 through the constant current circuit 125 from the scan electrode Y 124.

Then, when the voltage of the scan electrode Y 124 reaches the voltage V3, the switching signal VCN is switched and in accordance with the switching signal VCN the second terminal TE and the third terminal TF are connected in the switching circuit 123. Accordingly, an electric power is supplied to the fourth power supply 122 through the constant current circuit 125 from the scan electrode Y 124. Thereafter, the driving signal DRN is turned off and the constant current circuit 125 is turned off.

By configuring this way, the loss in the driving circuit when applying the slope waveform of the ultimate voltage V4 to the scan electrode Y 124 can be reduced.

Figure 7:
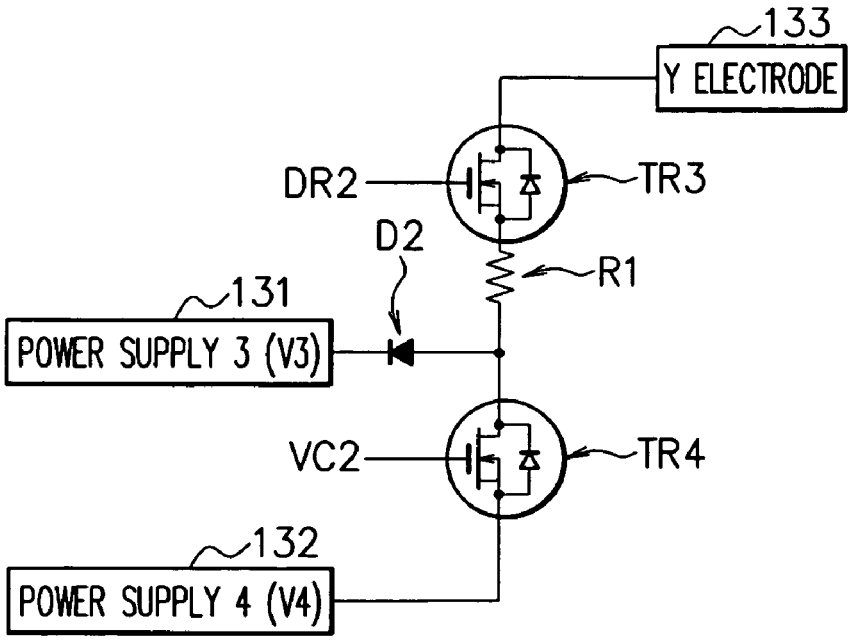
FIG. 7 is a view showing a specific example of the configuration of the slope waveform generating circuit in the second embodiment.

FIG. 7 is a view showing a specific example of the slope waveform generating circuit in the second embodiment. A reference numeral 131 represents the third power supply for supplying the voltage V3, and a reference numeral 132 represents the fourth power supply for supplying the voltage V4. Here, the voltage V4 is equal to the ultimate voltage (−Vw) of the slope waveform, and the voltage V3 is a voltage of ½ of the voltage V4.

TR3 represents an MOS transistor as the constant current circuit, and R1 represents a resistor. The MOS transistor TR3 and resistor R1 correspond to the constant current circuit 125 shown in FIG. 6. TR4 represents an MOS transistor as a switching element, and D2 represents a diode. The MOS transistor TR4 and the diode D2 correspond to the switching circuit 123 shown in FIG. 6.

A driving signal DR2 is supplied to the gate of the MOS transistor TR3, which is on/off controlled in accordance with the driving signal DR2. A switching signal VC2 is supplied to the gate of the MOS transistor TR4, which is on/off controlled in accordance with the switching signal VC2. The driving signal DR2 and the switching signal VC2 correspond to the driving signal DRN and the switching signal VCN shown in FIG. 6, respectively.

When applying a slope waveform of the ultimate voltage V4 to a scan electrode Y 133, first, the driving signal DR2 is turned on and the switching signal VC2 is kept turned off, thereby turning on only the MOS transistor TR3. Accordingly, an electric power is supplied to the third power supply 131 from the scan electrode Y 133 through the diode D2 and the MOS transistor TR3.

Then, when the voltage of the scan electrode Y 133 reaches the voltage V3, the switching signal VC2 is turned on and the MOS transistor TR4 is turned on, thereby turning off the diode D2. Accordingly, an electric power is supplied to the fourth power supply 132 from the scan electrode Y 133 through the MOS transistor TR3 and the MOS transistor TR4. Then, after the voltage applied to the scan electrode Y 113 reaches the ultimate voltage V4, the driving signal DR2 and the switching signal VC2 are turned off.

Accordingly, the loss in the driving circuit when applying the slope waveform of the ultimate voltage V4 to the scan electrode Y 133 can be reduced.

Other Embodiment

Although in the embodiments described above, a case where two power supplies are used those are a power supply which supplies a voltage corresponding to the ultimate voltage of the slope waveform and a power supply which supplies approximately a voltage of ½ thereof has been described, the present invention is not limited thereto and the number of the power supplies is optional.

Figure 8A:
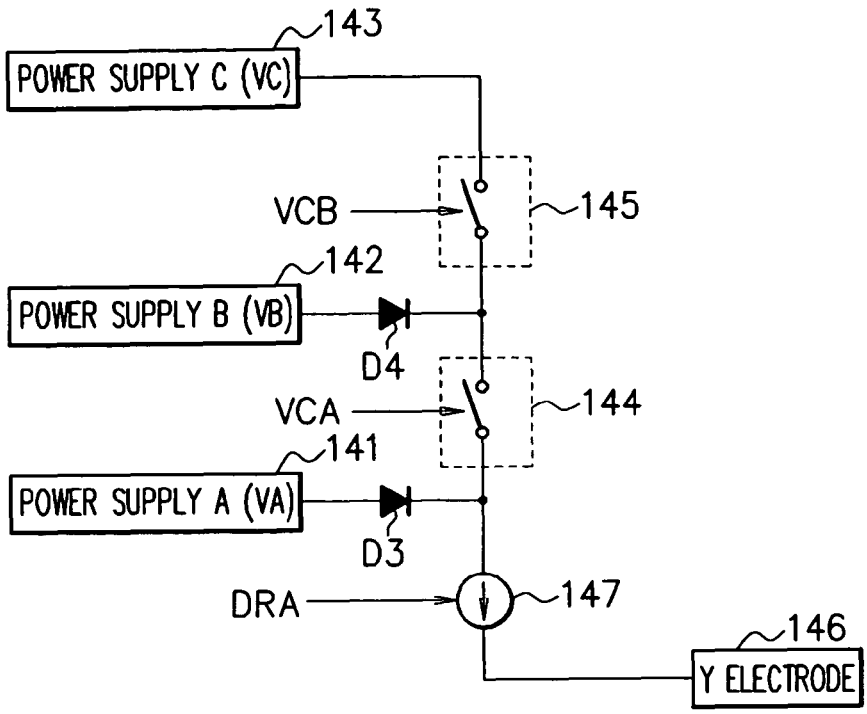
FIG. 8A is a view showing an example of a slope waveform generating circuit in another embodiment.
Figure 8B:
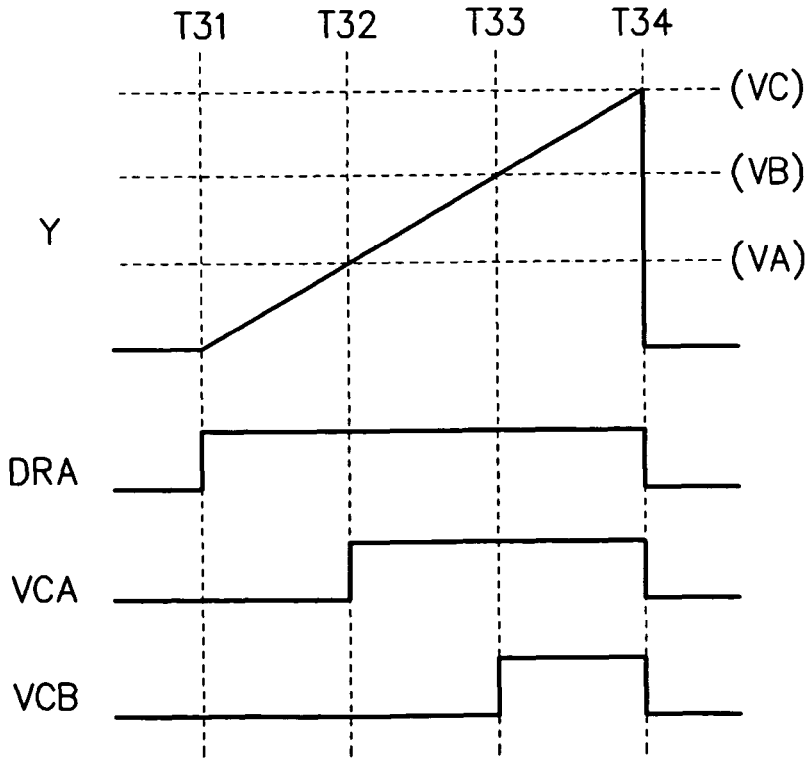
FIG. 8B is a waveform chart showing an example of the operation of the slope waveform generating circuit shown in FIG. 8A.

FIG. 8A and FIG. 8B are views showing an example of a slope waveform generating circuit in another embodiment of the present invention. The slope waveform generating circuit shown in FIG. 8A uses three power supplies of which supply voltages differ to each other, and it generates and outputs a slope waveform of which ultimate voltage is the positive voltage Vw relative to the reference voltage.

In FIG. 8A, a reference numeral 141 represents a power supply A for supplying a voltage VA, a reference numeral 142 represents a power supply B for supplying a voltage VB, and a reference numeral 143 represents a power supply C for supplying a voltage VC. Here, the voltage VC is equal to the ultimate voltage Vw of the slope waveform, the voltage VA is a voltage of approximately ⅓ of the voltage VC, and the voltage VB is a voltage of approximately ⅔ of the voltage VC. In addition, the voltages VA and VB are preferably voltages of ⅓ and ⅔ of the voltage VC, respectively, in order to minimize the reactive power (loss).

Reference numerals 144 and 145 represent switching elements. The switching element 144 is on/off controlled by a switching signal VCA, and the switching element 145 is on/off controlled by a switching signal VCB. D3 and D4 represent diodes. A reference numeral 147 represents a constant current circuit for supplying an electric power to a scan electrode Y 146, which constant current circuit is controlled by a driving signal DRA. The switching signals VCA and VCB and the driving signal DRA are supplied from the control circuit 5.

The power supply A 141 is connected to the scan electrode Y 146 through the diode D3 and the constant current circuit 147, and the power supply B 142 is connected to the scan electrode Y 146 through the diode D4, the switching element 144, and the constant current circuit 147. The power supply C 143 is connected to the scan electrode Y 146 through the switching elements 145 and 144 and the constant current circuit 147.

Next, an example of the operation of the slope waveform generating circuit shown in FIG. 8A is described with reference to FIG. 8B. When applying a slope waveform of the ultimate voltage VC to the scan electrode Y 146, first, the driving signal DRA is turned on while keeping the switching signals VCA and VCB turned off. Accordingly, the constant current circuit 147 operates and an electric power is supplied to the scan electrode Y 146 from the power supply A 141 through the diode D3 and the constant current circuit 147 (at time T31).

Then, when the voltage rises with the lapse of time and the voltage of the scan electrode Y 146 reaches VA (at time T32), the switching signal VCA is turned on and the switching element 144 is turned on. At this time, the diode D1 is turned off, and an electric power is supplied to the scan electrode Y 146 from the power supply B 142 through the diode D4 and the switching element 144.

Subsequently, as the voltage rises with the lapse of time and the voltage of the scan electrode Y 146 reaches VB (at time T33), the switching signal VCB is further turned on and the switching element 145 is turned on. At this time, the diodes D1 and D2 are cut off, and an electric power is supplied to the scan electrode Y146 from the power supply C 143 through the switching elements 145 and 144.

Then, after the voltage applied to the scan electrode Y146 reaches the ultimate voltage VC, the driving signal DRA and the switching signals VCA and VCB are turned off (at time T34).

In this way, even if the slope waveform generating circuit is configured using three power supplies of mutually different voltages, the loss in the driving circuit can be reduced by sequentially switching the power supply which supplies an electric power each time the voltage applied to the scan electrode Y 146 reaches a predetermined voltage.

As described above, in the case where the slope waveform of which signal level (voltage) changes with time is applied to the electrode, by sequentially switching the power supply in accordance with the voltage supplied to the electrode and supplying the voltage, the potential difference between the both ends of the driving circuit can be reduced as compared with the conventional one, the loss in the driving circuit can be reduced, and the generation of heat due to the reactive power can be suppressed.

In addition, although in each embodiment described above, a case where the slope waveform generating circuit 20 is provided in the Y side circuit 3, and the slope waveform which changes with the lapse of time is applied to the scan electrode Y has been described, the present invention is not limited to thereto. For example, when applying to the common electrode X a slope waveform which changes with the lapse of time, the slope waveform generating circuit may be provided in the X side circuit 2, and when applying slope waveforms to both the common electrode X and the scan electrode Y, the slope waveform generating circuits may be provide in both the X side circuit 2 and the Y side circuit 3.

Moreover, the transistor shown as the constant current circuit and the switching element in each embodiment are just an example, and any transistor may be used as each constant current circuit and switching element.

In addition, the switching timing of the switching circuit for switching from the low voltage side power supply to the high voltage side power supply in the above embodiments is on the basis of the voltage supplied to the electrode. This may be configured by detecting the voltage supplied to the electrode and then switching based on this detected voltage, or by comparing this detected voltage with the low voltage side supply voltage or with the high voltage side supply voltage and then switching based on this result. Furthermore, in the case where a relationship between the rise and time in the voltage are known, the switching circuit may be operated based on the time from the starting time point of the slope waveform, and the present invention does not restrict the operation timing of the switching circuit, specifically.

Note that, the embodiments described above show just an example in implementing the present invention, and therefore it should not be appreciated that these embodiments restrict the technical scope of the present invention. That is, the present invention may be implemented in various forms without departing from its technical scope and spirit or its key characteristic features.

According to the present invention, when supplying to an electrode a slope waveform of which voltage changes with the lapse of time, the power supply to be selected from a plurality of power supplies which supply different voltages is sequentially switched in accordance with a voltage being supplied to the electrode to thereby supply a voltage to the electrode. Therefore, the difference between the voltage of a power supply and the voltage of the electrode applied to a driving circuit can be made smaller than was conventionally possible, and the loss in the driving circuit can be reduced. Accordingly, the increase in the reactive power involved in supplying the slope waveform can be suppressed, and the generation of heat due to the reactive power can be reduced.

What is claimed is:

1. A plasma display device, comprising:

a plasma display panel displaying images by applying a sustain discharge voltage to a capacitive load, the capacitive load serving as a display element; and a slope waveform generating circuit supplying, to an electrode formed in said capacitive load, a slope waveform having a voltage which changes with a lapse of time, said slope waveform generating circuit comprising:

a plurality of power supplies supplying respective, different voltages relative to the ground as the reference potential;

a switching circuit being connected to outputs from the plurality of power supplies, and selecting one output out of outputs from said plurality of power supplies; and a constant current circuit being connected to one output selected by the switching circuit, and supplying to the electrode by generating the slope waveform, said switching circuit selecting one output out of outputs from the plurality of connected power supplies, following the switching signal being input to the switching circuit in accordance with a output voltage of the slope waveform generating circuit being supplied to said electrode.

2. The plasma display device according to claim 1 wherein, following the switching signal being input to the switching circuit in accordance with a output voltage of the slope waveform generating circuit being supplied to said electrode, said switching circuit sequentially switches the plurality of connected power supplies in an ascending order of a output voltage of the power supply.

3. The plasma display device according to claim 2, wherein said switching circuit switches to the different power supply from the selected power supply, when the output voltage of the slope waveform generating circuit being supplied to said electrode has reached the output voltage of the power supply which is presently selected by the switching circuit.

4. The plasma display device according to claim 3, wherein the number of said power supplies is N (N is a natural number of two or more), and the output voltage of each power supply corresponds to each voltage into which an ultimate voltage of said slope waveform is divided by N.

5. The plasma display device according to claim 4, wherein the slope waveform generating circuit is configured by N which is a natural number of two or more, power supplies which respectively corresponds to each voltage into which an ultimate voltage of the slope waveform is divided by N, (N−1) switching elements which respectively corresponds to (N−1) power supplies which corresponds to (N−1) of each voltage except for an ultimate voltage, and (N−1) diodes connected in series between outputs of (N−1) power supplies and one end of the (N−1) switching elements which correspond to (N−1) power supplies, with an i-th power supply (i is a natural number from 1 to (N−1)) which corresponds to the i-th voltage from the smallest of each voltage which is N divided, i-th switching element which corresponds to the i-th power supply, and an i-th diode connected in series between the i-th power supply and one end of the i-th switching element being an i-th set, connecting the other end of the (N−1)th set switching element to the N-th set output of power supply, and connecting the other end of the i-th set switching element except for the (N−1)th set to the interconnection node between one end of the (i+1)th set switching element and the (i+1)th set diode, and connecting a constant current circuit supplying the output to the electrode and whose power source is the output from the interconnection node, to the interconnection node between one end of the first set switching element and the first set diode.

6. A plasma display device, comprising:

a plasma display panel displaying images by applying a sustain discharge voltage to a capacitive load, the capacitive load comprising a display element;

a control circuit outputting a control signal; and a slope waveform generating circuit supplying a slope waveform whose voltage is changing at the predetermined ratio to an electrode of said capacitive load, and comprising:

a plurality of power supplies supplying respective, different voltages relative to the ground as the reference potential; and a switching circuit selecting the power supply in accordance with said control signal, wherein said slope waveform generating circuit supplies the respective voltage by said selected power supply to said electrode through a constant current circuit a constant current circuit being connected to one output selected by the switching circuit, and supplying to the electrode by generating the slope waveform.

7. The plasma display device according to claim 6, wherein said switching circuit sequentially selects one power supply out of said plurality of power supplies in an ascending order of a potential difference between the respective voltage of the selected power supply and a reference potential.

8. The plasma display device according to claim 6, wherein said switching circuit selects the different power supply from the selected power supply when the respective voltage supplied thereby to said electrode reaches a voltage level which the selected power supply can supply.

9. The plasma display device according to claim 6, wherein said slope waveform generating circuit uses a plurality of power supplies to provide a slope waveform signal having an applied voltage varying in time.

10. A plasma display device, comprising:

a plasma display panel displaying images by applying a sustain discharge voltage to a capacitive load, the capacitive load comprising a display element;

a slope waveform generating circuit supplying a slope waveform whose voltage is changing at the predetermined ratio to an electrode of the capacitive load, and comprising:

a first power supply supplying a first voltage relative to the ground as the reference potential, a second power supply supplying a second voltage relative to the ground as the reference potential, a switching circuit coupling the first power supply to the electrode and enabling the second power supply to add and to couple with the electrode, and a constant current circuit being connected to the switching circuit and generating the slope waveform.

11. The plasma display device according to claim 10, further comprising:

a control circuit outputting a control signal to the switching circuit; and the switching circuit enabling the second power supply to supply the second voltage to the electrode in accordance with the control signal.

12. The plasma display device according to claim 10, wherein said switching circuit enables the second power supply to couple with the electrode when the voltage being supplied to the electrode reaches the voltage of the first power supply.

13. The plasma display device according to claim 12, wherein the voltage of the first power supply is lower than the voltage of the second power supply.

14. The plasma display device according to claim 10, wherein said slope waveform generating circuit supplies a slope waveform of an applied voltage varying in time by the first power supply and the second power supply.

15. A plasma display device, comprising:

a plasma display panel displaying images by applying a sustain discharge voltage to a capacitive load, the capacitive load comprising a display element;

a slope waveform generating circuit which provides a slope waveform to an electrode of the capacitive load, and comprising:

a first power supply which supplies a first voltage, a second power supply which supplies a second voltage, and a switching circuit which changes a coupling state of the electrode to the first power supply and to the second power supply a constant current circuit being connected to one output selected by the switching circuit, and supplying to the electrode by generating the slope waveform.

16. The plasma display device according to claim 15, further comprising:

a control circuit outputting a control signal to the switching circuit; and the switching circuit changing the coupling state of the electrode in accordance with the control signal.

17. The plasma display device according to claim 15, wherein said switching circuit changes the coupling state of the electrode when the voltage being supplied to said electrode reaches the first voltage.

18. The plasma display device according to claim 17, wherein the first voltage Is lower than the second voltage.

19. The plasma display device according to claim 18, wherein said slope waveform generating generation circuit provides a slope waveform of an applied voltage varying in time, by the first power supply and the second power supply.

* * * * *

UNITED STATES PATENT AND TRADEMARK OFFICE

CERTIFICATE OF CORRECTION

PATENT NO. : 7,773,052 B2
APPLICATION NO. : 11/514971
DATED : August 10, 2010
INVENTOR(S) : Masaki Kamada et al.

It is certified that error appears in the above-identified patent and that said Letters Patent is hereby corrected as shown below:

Column 14, Line 33 delete "claim 18," and insert -- claim 15, --, therefor.

Column 14, Line 34 before "circuit" delete "generation".

Signed and Sealed this
Twenty-second Day of February, 2011

David J. Kappos

David J. Kappos
*Director of the United States Patent and Trademark Office*